US008310508B2

(12) United States Patent
Hekstra et al.

(10) Patent No.: US 8,310,508 B2
(45) Date of Patent: Nov. 13, 2012

(54) METHOD AND DEVICE FOR PROVIDING PRIVACY ON A DISPLAY

(75) Inventors: Gerben Johan Hekstra, Eindhoven (NL); Ruben Rajagopalan, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 389 days.

(21) Appl. No.: 12/744,350

(22) PCT Filed: Nov. 21, 2008

(86) PCT No.: PCT/IB2008/054889

§ 371 (c)(1), (2), (4) Date: May 24, 2010

(87) PCT Pub. No.: WO2009/069048

PCT Pub. Date: Jun. 4, 2009

(65) Prior Publication Data

US 2010/0231618 A1 Sep. 16, 2010

(30) Foreign Application Priority Data

Nov. 29, 2007 (EP) ..... 07121851

(51) Int. Cl.
*G09G 5/10* (2006.01)

(52) U.S. Cl. ..... 345/690; 345/88; 345/89

(58) Field of Classification Search ..... 345/84, 345/87–89, 102, 690; 348/E9.012, E9.027; 349/56, 84, 139, 144

See application file for complete search history.

(56) References Cited

U.S. PATENT DOCUMENTS

| | | | | |
|---|---|---|---|---|
| 5,818,925 | A | 10/1998 | Anders et al. | |
| 5,936,596 | A | 8/1999 | Yoshida et al. | |
| 7,324,181 | B2 * | 1/2008 | Lazarev et al. | 349/119 |
| 7,969,463 | B2 * | 6/2011 | Takaki | 348/59 |
| 2003/0146893 | A1 | 8/2003 | Sawabe | |
| 2005/0231661 | A1 * | 10/2005 | Lazarev et al. | 349/106 |
| 2006/0044290 | A1 | 3/2006 | Hurwitz et al. | |
| 2006/0103615 | A1 * | 5/2006 | Shih et al. | 345/88 |
| 2006/0192747 | A1 * | 8/2006 | Yoon et al. | 345/102 |
| 2006/0262057 | A1 | 11/2006 | Sumiyoshi | |
| 2007/0035706 | A1 * | 2/2007 | Margulis | 353/122 |
| 2007/0279359 | A1 * | 12/2007 | Yoshida et al. | 345/89 |
| 2007/0279372 | A1 * | 12/2007 | Brown et al. | 345/102 |
| 2008/0049048 | A1 * | 2/2008 | Credelle et al. | 345/690 |

OTHER PUBLICATIONS

Gass et al: "Privacy LCD Technology for Cellular Phones"; Sharp Technical Journal, No. 27, Sharp Laboratories of Europe Ltd. & Mobile LCD Group, 2007, 5 Page Document.

* cited by examiner

*Primary Examiner* — Kimnhung Nguyen

(57) ABSTRACT

The present invention relates to a processing device and a method of providing privacy for a display device comprising a display panel arranged to display a first image signal (405), the display panel having an off-axis tonal reproduction curve that is different from the on-axis tonal reproduction curve of the display panel, and the display panel comprising a group of adjacent subpixels, wherein subpixels of the group of adjacent subpixels contribute at least a common primary color component, and wherein the group of adjacent subpixels associated with at least one pixel; the method comprising modulating control signals of individual subpixels of the group of adjacent subpixels, using a second image signal (425), the control signals arranged to generate tonal values for at least two of the individual subpixels of the group of adjacent subpixels that are at least in part decorrelated from the first image signal when viewed off-axis, and to generate tonal values for the group of adjacent subpixels that on average correspond to the first image signal when viewed on-axis.

14 Claims, 7 Drawing Sheets

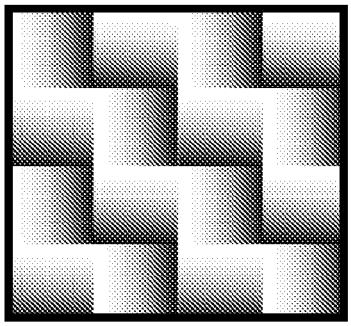
FIG. 6A
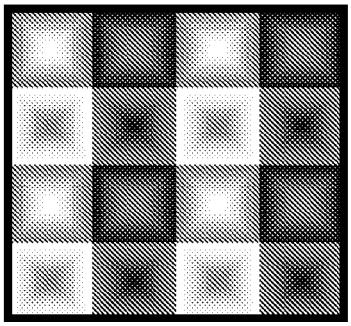
FIG. 6B
Account no.
154.224.123
Credit:
$ 2345.00
FIG. 6C
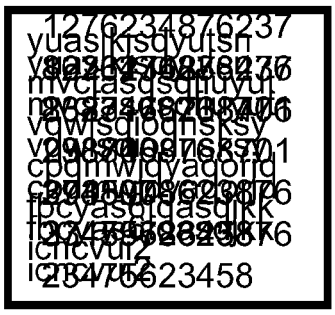
FIG. 6D

METHOD AND DEVICE FOR PROVIDING PRIVACY ON A DISPLAY

FIELD OF THE INVENTION

The present invention relates to a method and apparatus for providing privacy for a display device comprising a display panel.

BACKGROUND OF THE INVENTION

In the last two decades the number of light-weight display devices has grown at a staggering rate. Examples of such light-weight display devices are e.g. mobile phones, personal digital assistants (PDAs), portable DVD players, and portable game consoles.

Such devices are often used in public places, quite often in the presence of others. As a result, the information presented on these display devices may become visible to others, e.g. to fellow passengers on a train or subway. In crowded public areas there is little privacy, and software and hardware features that can provide additional privacy are greatly appreciated by users of display devices.

Various solutions have been conceived to address this problem and to improve the privacy of such display devices, e.g. by means of a security film which is attached to the screen.

A disadvantage of the above solution is that having to apply and/or remove the film is undesirable. "Privacy LCD Technology for Cellullar Phones" by, Paul Glass et al, published in Sharp Technical Journal, No. 27, 2007, presents an alternative, switchable, solution which is suitable for mass manufacture. This paper proposes the use of an Electrically Controlled Birefringence (ECB) switch panel to provide additional privacy. When a small voltage is applied to the ECB switch panel, the liquid crystal tilts out of the plane of the glass panel. The plane in which the liquid crystal tilts remains parallel to the polarizers of the panel, therefore light propagating near the on-axis direction of the display is not affected by the switch panel. However, light propagating at a large angle to the on-axis direction has its plane of polarization rotated by the tilted liquid crystal layer. This light is then blocked by an additional polarizer, giving a dark view to the sides. Although switchable, the above solution requires an additional optical layer in the display panel.

SUMMARY OF THE INVENTION

It is an object of the present invention to provide privacy for a display device comprising a display panel that does not require an additional optical layer.

This object is achieved by a method of providing privacy for a display device comprising a display panel arranged to display a first image signal, the display panel having an off-axis tonal reproduction curve that is different from the on-axis tonal reproduction curve of the display panel, and the display panel comprising a group of adjacent subpixels, wherein subpixels of the group of adjacent subpixels contribute at least a common primary color component and wherein the group of adjacent subpixels is associated with at least one pixel, and the method comprising modulating control signals (also referred to as drive signals) of individual subpixels of the group of adjacent subpixels, using a second image signal, the control signals arranged to generate tonal values for at least two of the individual subpixels of the group of adjacent subpixels that are at least in part decorrelated from the first image signal when viewed off-axis, and to generate tonal values for the group of adjacent subpixels that on average correspond to the first image signal when viewed on-axis.

The present invention capitalizes on the fact that certain display devices provide tonal reproduction curves on-axis that differ from the tonal reproduction curves off-axis. This difference relates to the tonal reproduction curves of the individual subpixels of a display panel, i.e. the subpixels that contribute to individual pixels.

The present invention uses the fact that within a group of adjacent subpixels that contribute at least a common primary color component to at least one pixel there is some freedom to generate a particular tonal value. Due to the composition of the group, and due to the freedom to generate a particular tonal value using this group, it is possible to modulate control signals of individual subpixels of the group of adjacent subpixels to generate different tonal values for a pixel viewed on-axis and off-axis.

By modulating control signals of individual subpixels of the group of adjacent subpixels, using a second image signal, the tonal values as perceived by an off-axis viewer can be decorrelated from the tonal values as perceived by an on-axis viewer, which on average corresponds to the first image signal.

In the above manner, the method according to the present invention can provide privacy without the need for an additional optical layer in the display panel.

Thus, the present invention allows switching between a public mode and a more private mode by means of modulating the control signals for the individual subpixels or alternatively optimizing them for off-axis viewing.

As the present invention does not require application or activation of an additional optical layer, the present invention can also be used to provide privacy for one or more selected parts of the display. In this manner, privacy can be provided for privacy-sensitive information on the display while leaving the remainder of the display unaffected.

In an embodiment according to the present invention, the modulation relates to spatial modulation, wherein control signals of spatially adjacent subpixels are modulated.

In a further embodiment according to the present invention, the modulation relates to temporal modulation, wherein control signals of temporally adjacent subpixels are modulated. Optionally, temporal and spatial modulation may be combined in order to create more headroom for modulation.

In an embodiment according to the present invention, the group of adjacent subpixels comprises subpixels from multiple adjacent pixels. In this manner, additional headroom is created for modulation.

In an embodiment, the dynamic range of the first image signal is reduced prior to displaying. In this manner, the image signal can be positioned in a tonal region that provides substantially more headroom for modulation.

In an embodiment, the second signal is a patterned signal. As a result, off-axis perception of the first image signal is complicated as the pattern present in the second signal will dominate more subtle variations resulting from the first image signal.

In an embodiment, the size of the pattern in the second signal is based on the size of an image feature present in the first image signal. As a result, the pattern used to obfuscate the first image signal when viewed off-axis can be tuned to match features in the first image signal, thereby further complicating feature recognition of the first image signal when viewed off-axis.

In an embodiment, the type of the second image signal is based on the type of the first image signal, thereby complicating feature recognition of the first image signal when viewed off-axis.

In an embodiment, the dynamic range of the second image signal is mapped on the available headroom, as determined by the first image signal and the tonal reproduction curve of the display panel. By using substantially all available headroom, the level of off-axis obfuscation is increased.

In an embodiment, the second image signal is chosen such that the image when viewed on-axis corresponds on average to the first image signal and when viewed off axis corresponds on average to a third image signal, whenever the available headroom so allows. In this manner, the second image can be used to provide off-axis viewers with an impression that they perceive the proper on-axis image.

The goal is further achieved by a processing device according to claim 12.

The processing device according to the present invention is preferably comprised in a display device according to claim 13.

BRIEF DESCRIPTION OF THE DRAWINGS

These and other advantageous aspects of the invention will be described in more detail, using the following Figures.

FIG. 6A shows an example of a second image signal for use with the present invention;

FIG. 6B shows a further example of a second image signal for use with the present invention;

FIG. 6C shows an example of a first image signal for use with the present invention;

FIG. 6D shows an example of a second image signal for use with the present invention;

The Figures are not drawn to scale. Generally, identical components are denoted by the same reference numerals in the Figures.

DETAILED DESCRIPTION OF EMBODIMENTS

The present invention proposes a technique for enabling switchable private viewing of still images or motion video, on display devices comprising a display panel having an off-axis tonal reproduction curve that is different from the on-axis tonal reproduction curve. Good examples of such display panels are e.g. Liquid Crystal Display (LCD) panels of the twisted nematic (TN) or vertical alignment (VA) types, both using transmissive display technology.

The present invention is however not limited to displays of the transmissive, reflective and/or transflective type, owing to the difference in transmission of the display panel. However, the invention may also be advantageously used for other display panels, provided that they have an off-axis tonal reproduction curve that is different from the on-axis tonal reproduction curve.

The present invention exploits the flexibility in assigning individual control signals for subpixels of groups of adjacent subpixels of the display panel for generating tonal values. This flexibility is used to selectively reduce the viewing angle when so required. In the private mode, the tonal value observed on-axis, on average remains in line with the displayed image signal, whereas the tonal value observed off-axis is decorrelated from the displayed image signal.

Figure 1B:
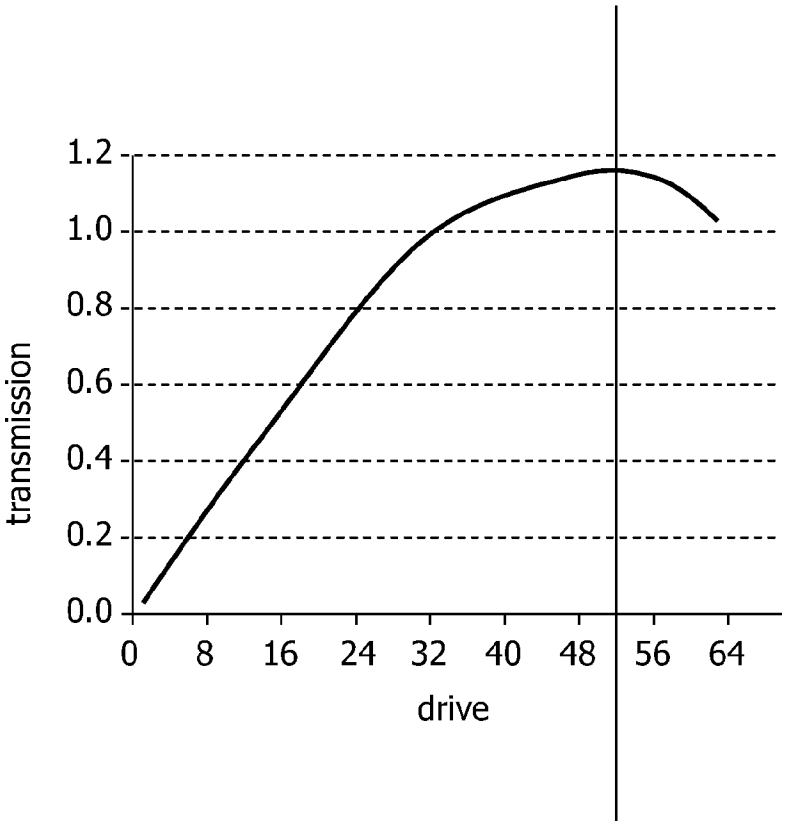
FIG. 1B shows an off-axis sub-pixel transmission curve.
Figure 1A:
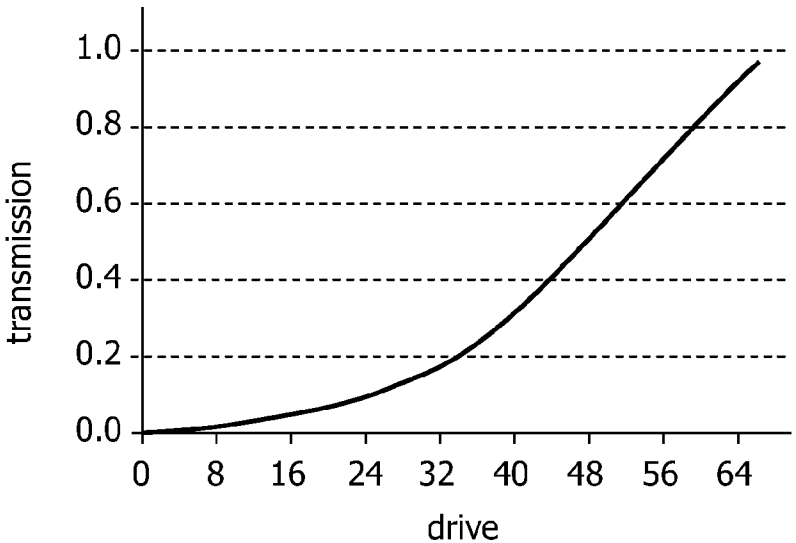
FIG. 1A shows an on-axis sub-pixel transmission curve.

FIG. 1A and FIG. 1B respectively show on-axis and off-axis behavior of the transmission curve of a VA LCD. The transmission curve here refers to the voltage transmission curve, TV curve, sometimes also referred to as gamma curve, for a VA LCD. FIG. 1A presents the on-axis transmission curve (0° degrees on-axis). In addition, FIG. 1B shows the off-axis transmission curve (60° degrees off-axis). These figures show the transmission curve, however, the transmission curve of a VA LCD display is directly related to the tonal reproduction curve.

The figures clearly indicate that the on-axis and off-axis behavior differ. At a drive strength of 32 the transmission on-axis is roughly 0.2, whereas for off-axis viewing it is roughly 1.0. Moreover, it is noted that the off-axis curve depicts an inversion effect; an increase in drive strength beyond a particular value does not result in an increase in transmission, but in a decrease in transmission instead.

In VA LCD displays that exhibit the above behavior, a change of the viewing angle from on-axis to off-axis will result in substantial variations in tonal reproduction for the respective color components. This in turn will result in a color shift that is particularly visible for skin tones.

The state-of-the-art solution for correcting this color shift problem is to use two or more sub-pixels that both contribute at least a part of common primary color components. When using RGB subpixels, such a display may e.g. duplicate some or all of the subpixels that contribute to a single pixel. In practice this implies that there are e.g. two red (R) subpixels, two green (G) subpixels and two blue (B) subpixels that all contribute to one and the same pixel. It will be clear to the skilled person that other configuration may also be possible, such as RGBG which uses four subpixels and effectively only duplicates the green component. In addition, other configurations such as RGBW displays can be used that further comprise a white (W) subpixel. Finally, the present invention can also be applied in systems that use multiple temporally-adjacent sub-frames to reproduce the tonal values of a particular image frame. As a result of the use of the subframes, the tonal reproduction of a perceived image pixel is the sum of the contributions from multiple temporally adjacent subpixels. In such a system there can be, as a result of the use of multiple subpixels, freedom in creating a particular tonal value. This in turn can be used to complicate off-axis viewing by modulating the control signals of at least one spatial subpixel over time, i.e. over multiple sub-frames, preferably over sub-frames corresponding to a particular image frame. It will be clear to the skilled person that combinations of spatial and temporal modulation are also envisaged.

Figure 2:
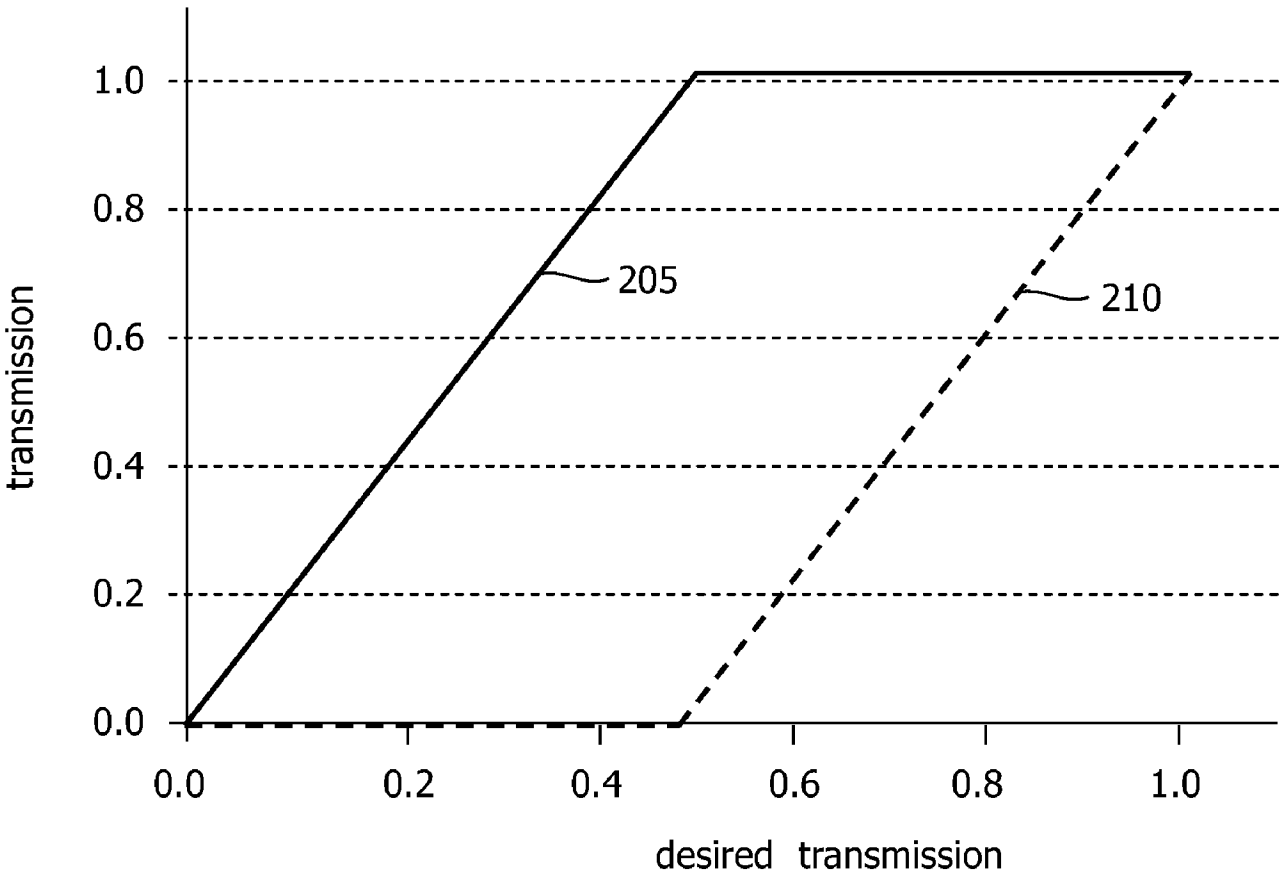
FIG. 2 shows individual sub-pixel luminance for realizing an improved off-axis tonal curve of a pixel, using two sub-pixels.

FIG. 2 shows two control signals 205 and 210 for two subpixels that contribute the same primary color components for one pixel of a display panel. The x-axis shows the desired luminance whereas the y-axis represents the contribution of a subpixel therein. The underlying idea is that each subpixel accounts for half of the maximum normalized transmission.

In order to implement normalized transmission values that are smaller than or equal to half of the maximum normalized transmission only one of the subpixels is used. Both subpixels are used when higher transmission values are required.

Figure 3:
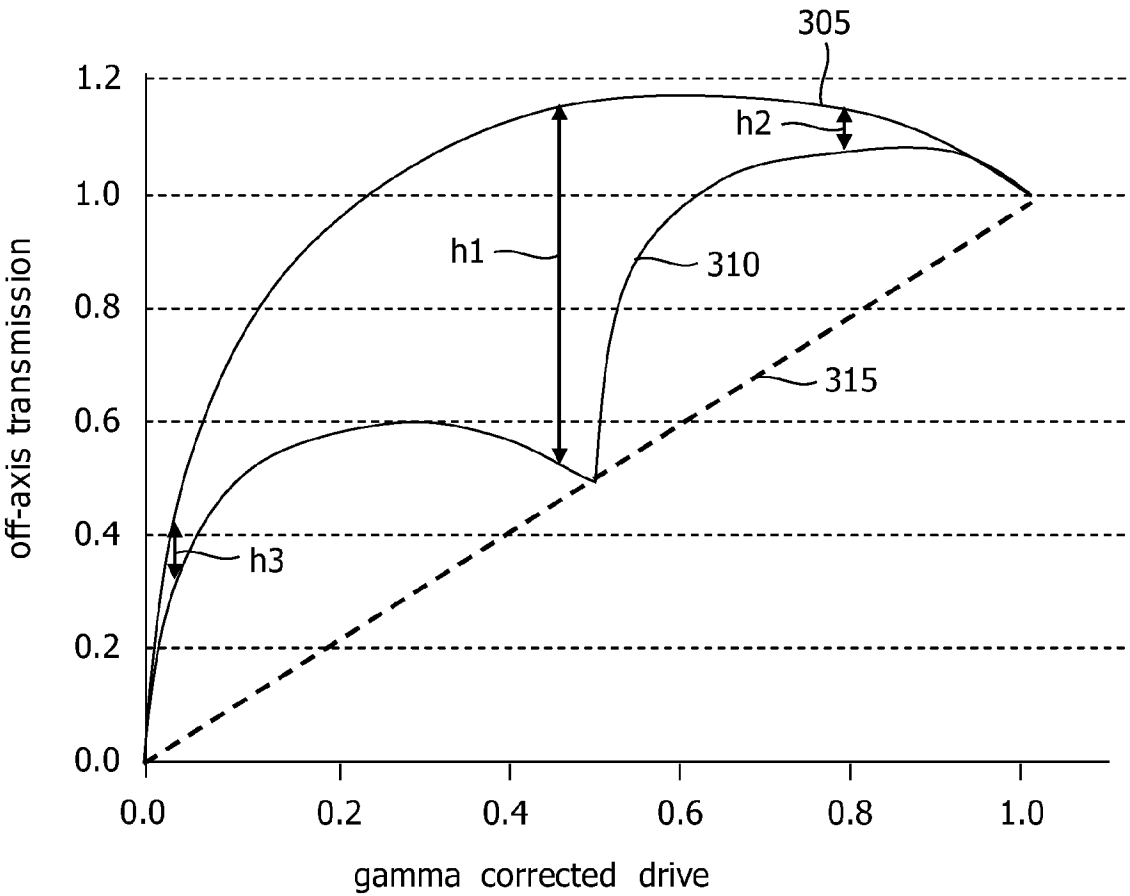
FIG. 3 shows pixel tonal curve for off-axis viewing implemented using two sub-pixels.

FIG. 3 shows the resulting off-axis improvement. Here the x-axis corresponds to the gamma-corrected drive level, which corresponds to a unique voltage level applied to the LC-cell. The y-axis corresponds to the resulting off-axis transmission.

Curve 305 corresponds to the off-axis transmission curve of a single subpixel solution, the dashed curve 315 corresponds to the ideal (on-axis) transmission curve. Finally, curve 310 shows the tonal reproduction curve of the two-subpixel solution using the control signals as described with reference to FIG. 2.

The tonal reproduction curve 310, being the two-subpixel solution, is substantially closer to the ideal curve, dashed line 315.

The inventors of the present invention have realized that the above mechanism, i.e. the use of multiple subpixels that contribute at least one common color component for a pixel, provides an additional level of freedom with regard to generating a particular tonal value for that pixel. The present invention in turn uses this freedom in that it assigns drive signals for the individual subpixels, such that the tonal value perceived on-axis differs from that perceived off-axis in that the off-axis image is decorrelated from the on-axis image.

The same principle can also be applied to displays that do not use multiple subpixels that contribute at least part of one color component. In this case, subpixels of multiple pixels can be grouped, thereby creating a "super-pixel" that effectively comprises multiple-subpixels that contribute at least part of one color component. In this case, privacy will come at a cost in that the perceived resolution is that of the "super-pixels".

Modulating Control Signals

Figure 4:
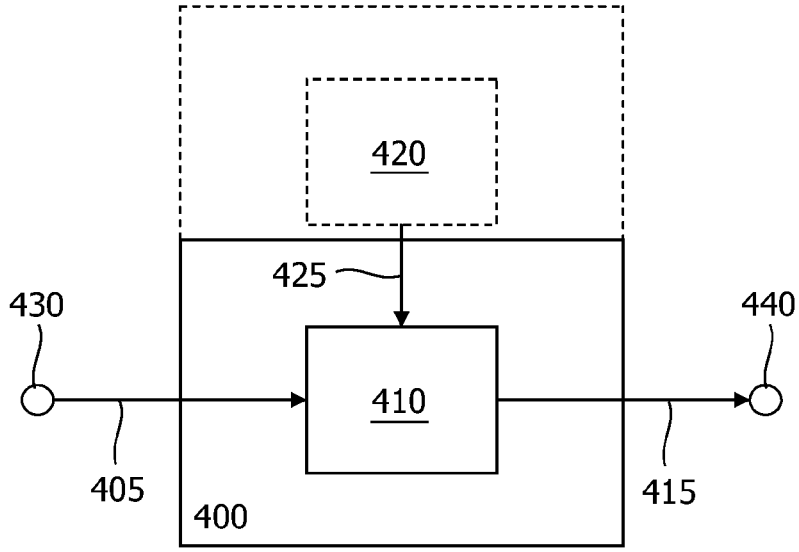
FIG. 4 shows a block diagram of a processing device according to the present invention.

In accordance with the present invention, the drive signals in private mode are modulated using a noise signal. FIG. 4 shows a processing device 400 for generating subpixel control signals 415 for providing privacy for a display device comprising a display panel arranged to display a first image signal 405. This display panel has an off-axis tonal reproduction curve that is different from the on-axis tonal reproduction curve of the display panel, and the display panel comprises a group of adjacent subpixels, wherein subpixels of the group of adjacent subpixels contribute at least a common primary color component and wherein the group of adjacent subpixels is associated with at least one pixel.

The processing device 400 has an input connector 430 for receiving the first image signal 405. The first image signal 405 is subsequently provided to a modulating means 410 that is arranged to generate control signals 415 of individual subpixels of the group of adjacent subpixels. The modulating means 410 receives a second signal 425, preferably an image signal, which is used to modulate the control signals 415. A wide variety of modulation types are envisaged, and a particularly advantageous version thereof will be described next with reference to FIG. 5. As indicated in FIG. 4 by means of dashed lines, the processing device may comprise a signal generator 420 for generating the second signal 425, or may alternatively receive the second signal 425 from another source.

As described with reference to FIG. 3, in a display device that uses two subpixels to generate a color component corresponding to a single pixel, two transmission curves can be realized, a first tonal reproduction curve 305 corresponding to a drive signal with poor-quality off-axis tonal reproduction, and the second tonal reproduction curve 310 corresponding to a drive signal for optimized off-axis tonal reproduction for the pixel.

The inventors realized that by modulating the drive signals it is possible to partially or fully decorrelate the off-axis-perceived image signal from the first image signal being displayed. In order to do so the inventors propose to use a noise signal to modulate the drive signal.

In a preferred embodiment, two sets of drive signals are computed:

$G_{low}$ corresponding to the lowest possible off-axis transmission (transmission curve 310), wherein $G_{low}=\{G_{1,low}, G_{2,low}\}$ and $G_{1,low}=\max(0, (2G-1))$ $G_{2,low}=\min(1,2G)$ wherein G corresponds to the transmission value that is to be reproduced (resulting in a desired perceived transmission/tonal value).

$G_{high}$ corresponding to the highest possible off-axis transmission (transmission curve 305)

wherein $G_{high}=\{G_{1,high}, G_{2,high}\}$ and $G_{1,high}=G$ $G_{2,high}=G$

A modulated set of drive values G' can be computed from these two sets as a linear combination of $G_{high}$ and $G_{low}$ using a noise value α, wherein $$G'_1=(1-\alpha)\cdot G_{1,low}+\alpha\cdot G_{1,high}$$

$$G'_2=(1-\alpha)\cdot G_{2,low}+\alpha\cdot G_{2,high}$$

Figure 5:
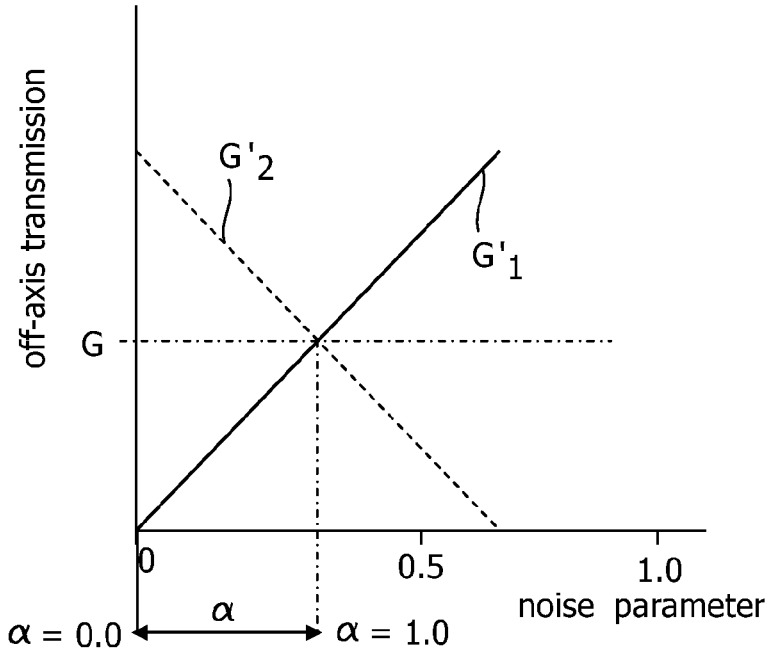
FIG. 5 illustrates the use of a noise value for generating sub-pixel control signals.

FIG. 5 shows a figure wherein on the x-axis the noise value is presented and on the y-axis the transmission value. In case the noise value α equals 1, the transmission for both $G'_1$ and $G'_2$ equals G, whereas when the noise value α is 0, the transmission for $G'_1$ and $G'_2$ is 2G and 0, respectively.

Dynamic Range of the First Image Signal

As indicated above, the area between the transmission curves 305 and 310 reflects the headroom that is available for modulating the control/drive signals. As can be seen in FIG. 3, the difference between the off-axis transmission, however, differs substantially for different gamma-corrected drive values.

The available headroom h1 at a gamma-corrected drive of 0.5 is substantially larger than that at a gamma-corrected drive of 0.05 and 0.8. Consequently, the potential for obfuscation is substantially higher at a gamma-corrected drive of 0.5. As a result, it is advantageous to limit the dynamic range of the first image signal, e.g. in FIG. 3 the range 0.1-0.7, because this will improve the potential for transmission variation off-axis.

Patterned Noise

The noise signal used to modulate the drive signals can be random noise, but is preferably structured noise. Alternatively and/or additionally, structured image signals such as the images presented in FIG. 6A and FIG. 6B can be used. It was observed that the use of structured patterns effectively is preferable over the use of random noise. Random noise as such averages over time to zero, whereas a structured pattern such as those presented in FIG. 6A and FIG. 6B effectively frustrate time-based averaging.

In addition to the above analysis and selection, techniques can be used to match the type of the second image signal to that of the first image signal. Conventional image classification and feature size extraction techniques can be used to establish and match characteristics of such signals.

A good example of matching is presented in FIG. 6C and FIG. 6D. FIG. 6C represents an image signal that comprises privacy-sensitive information in the form of text characters as used in a banking application on a mobile phone. In order to maximize the headroom available for obfuscation, the text is preprocessed in order to map the black text onto a grey value. Through the use of a second image signal such as that of FIG. 6D, the off-axis legibility of the text can be substantially reduced.

As illustrated above for the text example, the second signal can be tuned to the type of information that is presented on screen. Further improvements are envisaged wherein for text representations the font sizes used in the second image signal are tuned to those found in the first image signal. Likewise the alignment of the text can be chosen to be in proximity of the original characters in the first image. In fact, well known image classification techniques may be used to select a suitable second image signal to obfuscate the first image signal.

As the first image signal may vary over time, so can the second image signal. Again with reference to FIG. 6D, additional characters can be displayed in the second image signal when additional characters appear in the first image signal. In this manner, temporal changes in the first image signal are reflected in other temporal changes in the second image, thereby complicating legibility for text.

It will be clear that static and or dynamic image classification and feature size extraction techniques can be used on both text images and non-text images. The outcome of such analysis is then preferably used to modify or alternate the second image signal.

Noise Optimization for Pre-determined Viewing Angle

In the above description, examples are presented wherein the second image signal is independent of the image; e.g. when using random, preferably non-zero mean noise. In addition, examples have been presented wherein the second image signal is in fact patterned. However, in a further embodiment of the present invention the second image signal is based on a first image signal, being the image signal that is preferably observed on-axis, and on a third image signal, being a further image signal different from the first image signal, that is to be observed from a predetermined off-axis viewing angle.

Using the same mechanism as presented above, this embodiment aims to determine a second image signal based on two image signals. The goal is to determine control signals for subpixels that result in a transmission value for on-axis viewing that substantially corresponds to the required transmission value for viewing the first image signal, and in parallel determines control signals for subpixels that result in a transmission value for off axis viewing at a predetermined off-axis viewing angle that realizes a transmission value corresponding to the third image signal.

Effectively, the above results in two equations are based on the first image signal, the third image signal and the off-axis transmission curve as presented in FIG. 3. The number of variables to be determined corresponds to the number of individual sub-pixel control signals. When there is insufficient headroom, these equations are over-constrained, in which case it is advisable to configure the second signal for correct on-axis viewing and use a random value $\alpha$ as discussed above.

It should be further noted that in a further optimization the type of the third image signal is made dependent upon classification information derived from the first image signal. In this manner, when the first image displays text, a third image may be generated comprising text of similar color and size.

Tiling

As indicated earlier, the present invention may be applied to displays that use multiple subpixels that contribute at least part of a common color component of each individual pixel. However, it may also be used in conjunction with a conventional display device with poor off-axis behavior. In this case the present invention proposes to group subpixels belonging to two or more adjacent pixels, and to modulate the subpixel control signals as if they belong to a "super-pixel" comprising the subpixels of the two or more adjacent pixels.

Although this way of working will effectively involve a visibly lower display resolution corresponding to that of "super-pixels", it will result in increased headroom for modulation.

Although the above clustering, or tiling, of subpixels may be used to improve the privacy of a simple TN or VA display with R, G and B subpixels, the same approach can also be used on displays that use multiple subpixels that contribute at least part of a common color component of each individual pixel to create even more headroom for modulating the subpixel control signals.

Figure 7:
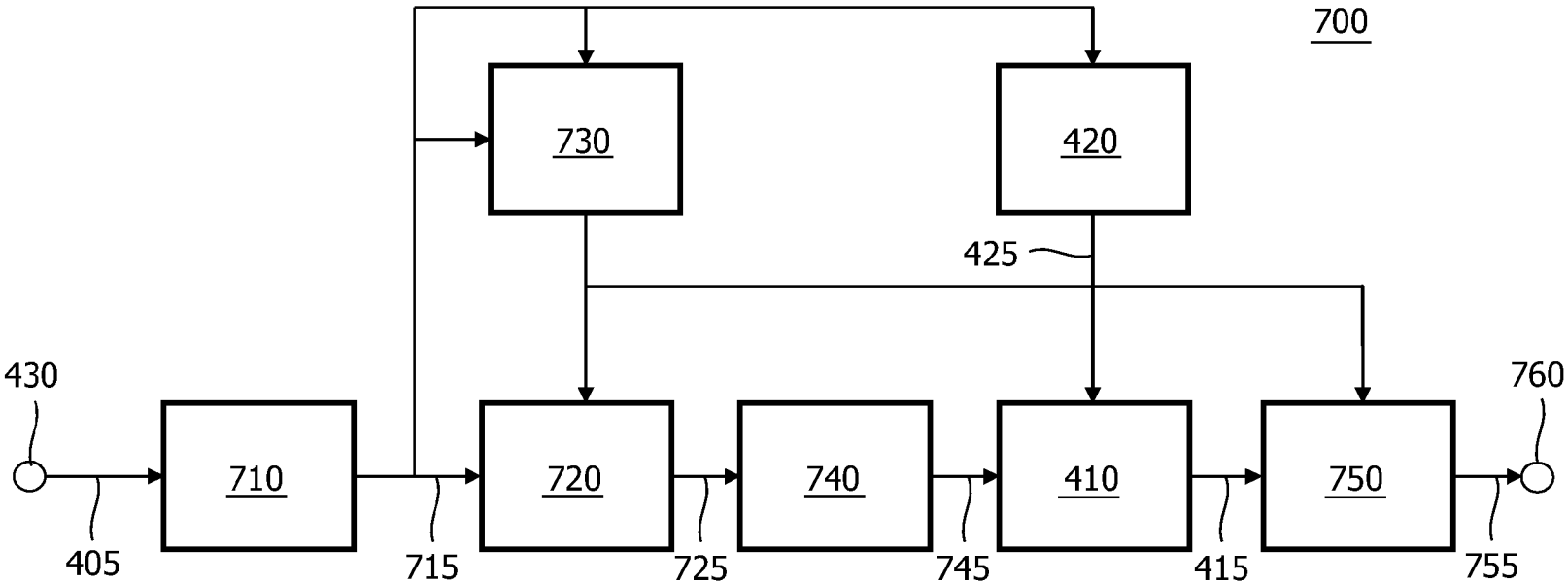
FIG. 7 shows a block diagram of a further processing device according to the present invention.

Throughout the above examples, the individual subpixels that contributed one and the same color component were similar subpixels, e.g. because they had a similar subpixel structure. This however is not mandatory. In fact the subpixels that contribute at least one color component in a group of pixels may have different tonal reproduction curves. It will be clear to the skilled person that this difference will have to be taken into account when modulating the control signals for the individual pixels. FIG. 7 presents a block diagram of a processing device 700 according to the present invention. The processing device 700 comprises an input connector 430 receiving a first image signal 405. The first image signal is sent to signal conditioning means 710, the signal conditioning means 710 is arranged to reduce the dynamic range of the first input image. Dynamic range limiting techniques are well known in the art of video processing and hence are not discussed here.

The output of the signal conditioning means is image signal 715. The pixels in the image signal 715 are subsequently grouped by a tiling means 720. The tiling means groups image information for subpixels of a tile into a group. As discussed above, depending on the implementation, these groups canspan subpixels of multiple image pixels. The size of the tiles in this embodiment is image-dependent, and tile analyzer means 730 analyzes the input image and, based thereon, determines the tile size.

The tile analyzer 730 analyzes the image signal in order to dynamically determine the tile size for the entire image, thereby creating a dynamically varying tile size. Although it is proposed here to use a single tile size for an image, this is not mandatory; in fact, using an image-dependent tile size may help provide additional headroom where needed at the cost of a loss in perceived image resolution. Alternatively, the tile analyzer 730 may group spatially adjacent pixels with similar luminance values into a tile. Once the image is tiled, the tiled image 725 is sent to a filtering means 740.

The filtering means 740 effectively determines a representative value 745 for all groups of subpixels for all tiles. In one embodiment, the representative value is the mean value, but other filtering operations that result in a representative value may be used to equal advantage. The output of the filtering means 740 is sent to the modulator 410 as described earlier with reference to FIG. 4.

The output of the modulator consists of a set of modulated drive signals for the subpixels of the tiles. Next, the drive signals need to be distributed over the subpixels in a tile. Although this can be done randomly, the components may also be distributed to spread the luminance more evenly over the tile. For example, when a two-pixel tile comprises six subpixels, i.e. three adjacent subpixels (RGB) for every image pixel, then the sub-pixel drive strengths can be distributed such that the difference in luminance between the two groups comprising three adjacent subpixels each is minimized.

Finally, the output of the de-tiling means 750, i.e. the modulated subpixel drive signals 755, are output on output connector 760.

Figure 8:
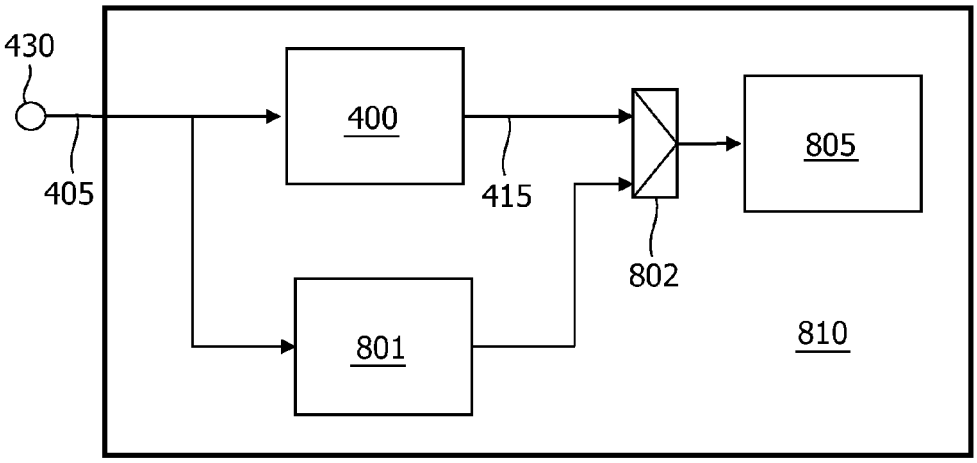
FIG. 8 shows block diagrams of a display device according to the present invention.

FIG. 8 shows block diagrams of two display devices according to the present invention. Display device 810 comprises processing device 400 as well as a conventional device 801 for generating subpixel drive signals. In addition, the device comprises a selection means 802 for providing either the modulated subpixel drive signal or a conventional subpixel drive signal to a display panel 805.

Figure 9:
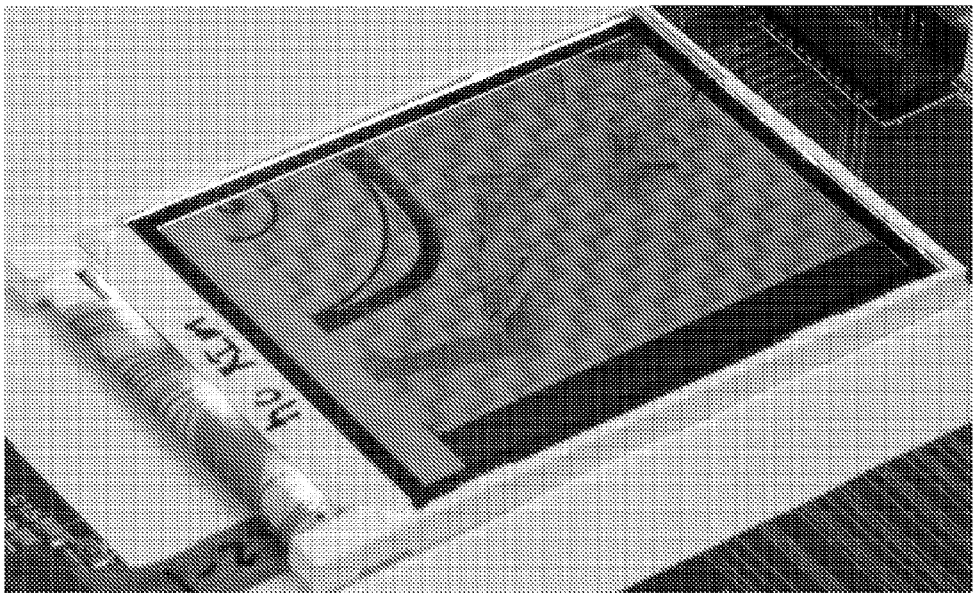
FIG. 9 shows a photograph of an experimental set-up displaying an image when viewed off-axis.

FIG. 9 shows a photograph of an experimental set-up that utilizes the pattern as presented with reference to FIG. 6A as the second image signal. The resulting image when viewed off-axis is substantially obfuscated, whereas the on-axis view is substantially unaffected.

Although the above has been described primarily with reference to example displays that use R, G and B subpixels to represent pixels, the present invention can be applied to equal advantage to e.g. multi-primary displays that further comprise yellow and cyan. In fact, the addition of additional primaries provides further headroom and thus may result in even better results.

Likewise, the present invention is explained primarily with reference to spatial modulation of the drive signals, however the invention can also benefit from the use of temporal modulation of the subpixel drive signals. The present invention is particularly interesting for systems as described earlier, wherein multiple temporally adjacent sub-frames are used to reproduce the tonal values of a particular image frame.

An apparatus and or the method according to the present invention can be effectively implemented in a device primarily in hardware form, e.g. using one or more Application Specific Integrated Circuits (ASICs). Alternatively, the present invention can be implemented on a programmable hardware platform in the form of a Personal Computer, or a digital signal processor having sufficient computational power. It will be clear to the skilled person that many different variations in hardware/software partitioning are possible within the scope of the claims.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim.

It will be clear that within the framework of the invention many variations are possible. It will be appreciated by persons skilled in the art that the present invention is not limited by what has been particularly shown and described hereinabove. The invention resides in each and every novel characteristic feature and each and every combination of characteristic features. Reference numerals in the claims do not limit the protective scope of the claims.

Use of the verb "to comprise" and its conjugations does not exclude the presence of elements other than those stated in the claims. Use of the article "a" or "an" preceding an element does not exclude the presence of a plurality of such elements.

The invention claimed is:

1. Method of providing privacy for a display device (810) comprising a display panel (805) arranged to display a first image signal (405), the display panel (805) having an off-axis tonal reproduction curve that is different from the on-axis tonal reproduction curve of the display panel (805), and the display panel (805) comprising a group of adjacent subpixels, wherein subpixels of the group of adjacent subpixels contribute at least a common primary color component and wherein the group of adjacent subpixels is associated with at least one pixel, the method comprising modulating control signals of individual subpixels of the group of adjacent subpixels using a second image signal (425), the control signals arranged to generate tonal values for at least two of the individual subpixels of the group of adjacent subpixels that are at least in part decorrelated from the first image signal when viewed off-axis, and to generate tonal values for the group of adjacent subpixels that on average correspond to the first image signal when viewed on-axis.

2. The method of claim 1, wherein the modulating step relates to at least one of spatially and temporally modulating.

3. The method of claim 1, wherein the group of adjacent subpixels comprises subpixels from multiple adjacent pixels.

4. The method of claim 1, further comprising:

reducing (710) the dynamic range of the first image signal (405) prior to displaying.

5. The method of claim 1, wherein the second image signal (425) is a patterned signal.

6. The method of claim 5, wherein the pattern size is based on an image feature present in the first image signal (405).

7. The method of claim 1, wherein the type of the second image signal (425) is based on the type of the first image signal (405).

8. The method of claim 1, wherein the dynamic range of the second image signal (425) is mapped on the available headroom as defined by the tonal reproduction curve of an individual subpixel and the tonal reproduction curve of the group of adjacent subpixels.

9. The method of claim 1, wherein the group of adjacent subpixels comprises multiple subpixels, each contributing at least one common primary component for a single pixel.

10. The method of claim 1, wherein the second image signal (425) is based on both the first image signal (405) and a third image signal, such that the image as viewed off-axis at a pre-determined angle substantially corresponds to the third image signal whenever the headroom for modulation allows, the headroom being defined by the tonal reproduction curve of an individual subpixel and the tonal reproduction curve of the group of adjacent subpixels.

11. The method of claim 10, wherein the type of the third image signal is based on the type of the first image signal (405).

12. Computer program product comprising program code means stored on a computer readable medium for performing the method of claim 1 when said program product is executed on a computer.

13. A processing device (400,700) for generating subpixel control signals for providing privacy for a display device (810) comprising a display panel (805) arranged to display a first image signal (405), the display panel (805) having an off-axis tonal reproduction curve that is different from the on-axis tonal reproduction curve of the display panel (805), and the display panel comprising a group of adjacent subpixels, wherein subpixels of the group of adjacent subpixels contribute at least a common primary color component and wherein the group of adjacent subpixels is associated with at least one pixel, the processing device comprising modulating means (410) arranged to modulate control signals of individual subpixels of the group of adjacent subpixels using a second signal, such that the control signals, when applied to the corresponding subpixels, generate tonal values for at least two of the individual subpixels of the group of adjacent subpixels that are at least in part decorrelated from the first image signal (405) when viewed off-axis, while generating tonal values for the group of adjacent subpixels that on average correspond to the first image signal when viewed on-axis.

14. A display device (810) having a user-selectable privacy mode, the display device comprising a display panel (805) arranged to display a first image signal (405), the display panel (805)

having an off-axis tonal reproduction curve that differs from the on-axis tonal reproduction curve of the display panel (805), and comprising a group of adjacent subpixels, wherein subpixels of the group of adjacent subpixels contribute at least a common primary color component and wherein the group of adjacent subpixels is associated with at least one pixel, the display device (810) further comprising a processing device (400,700) according to claim 13;

a selection means (802) for selecting a private display mode providing the output of the processing device (400,700) to the display panel (805) in the private display mode.

* * * * *